US005664514A

United States Patent [19]

Laan

[11] Patent Number: 5,664,514

[45] Date of Patent: Sep. 9, 1997

[54] TANKER PROVIDED WITH SWASH TYPE BULKHEADS

[76] Inventor: Markus Van Der Laan, Jan Evertsenlaan 18, NL-2341 SV Oestgeest, Netherlands

[21] Appl. No.: 569,079

[22] PCT Filed: Jun. 2, 1994

[86] PCT No.: PCT/NL94/00128

§ 371 Date: Feb. 5, 1996

§ 102(e) Date: Feb. 5, 1996

[87] PCT Pub. No.: WO94/29165

PCT Pub. Date: Dec. 22, 1994

[30] Foreign Application Priority Data

Jun. 4, 1993 [EP] European Pat. Off. ..... 93201603

[51] Int. Cl.[6] ..... B63B 25/03

[52] U.S. Cl. ..... 114/74 R

[58] Field of Search ..... 114/72, 73, 74 A, 114/74 R, 74 T, 75, 121, 122, 125

[56] References Cited

U.S. PATENT DOCUMENTS 3,164,120 1/1965 Field .

FOREIGN PATENT DOCUMENTS 2135936 12/1972 France .
2 158 020 5/1972 Germany .
WO 92/05069 4/1992 WIPO .
WO 92/08640 5/1992 WIPO .

*Primary Examiner*—Stephen Avila
*Attorney, Agent, or Firm*—Young & Thompson

[57] ABSTRACT

A tanker for carrying a liquid bulk cargo, provided with a full swash bulkhead. The bulkhead plating is closed watertight from deck to bottom except for one or more small holes (4) near the bottom.

2 Claims, 3 Drawing Sheets

TANKER PROVIDED WITH SWASH TYPE BULKHEADS

The present invention relates to a tanker for carrying a liquid bulk cargo such as (crude) oil and the like or for carrying different liquid products.

In present tanker design, swash bulkheads are fitted in liquid bulk cargo tanks in order to reduce structural damage caused by wave motions inside a cargo tank, in particular in partially filled conditions ("swash" means: slosh, bubble, burble, wash).

Generally a swash bulkhead is fitted at approximately half the length (breadth) of a cargo tank and allows "through-flow" of the cargo and thereby prevents hydrostatic loading.

Depending on the variety of different cargo fillings and tank shapes one of the following versions of bulkheads will be applied:

a) a total bulkhead (full swash) from deck to bottom, wherein a number of holes are spread across the total surface area;

b) an upper part bulkhead from deck downwards for part of the height, wherein the lower part is open; and c) a lower part bulkhead from bottom upwards part of height, wherein the upper part is open.

It will be appreciated by those skilled in the art that a conventional total swash bulkhead (full swash type) will have (large) holes spread across the total area, but at least one (limber) hole near the top and at least one (limber) hole near the bottom in order to prevent unintended hydrostatic loading (in case of operational errors or malfunctioning) and/or for draining purposes (bottom).

Swash bulkheads function a) by damping the surface (wave) movements of the cargo during movements of the vessel in sailing conditions (this is achieved by creating turbulence in the flow by means of sharp edges or holes), and b) by preventing wave resonance of the cargo by altering the (critical) tank length and/or breadth ratio (this is achieved by reflecting waves by means of a closed surface).

Known full swash type bulkheads contain a large number of holes spread over the total bulkhead area in order to damp the fluid movements in the tank and to allow a proper flow during normal cargo operations. The bulkhead structure is relatively light (thin plates and stiffeners) because no hydrostatic loading occurs.

In general, this construction performs properly. However, due to disasters with (crude) oil carriers and their large pollutional effect, a world-wide effort is made to improve the safety of tankers and nowadays there is an increasing need to construct tankers in such a way that in case of wreck or other marine catastrophe leakage of cargo and thus environmental pollution is avoided or minimized.

A solution for this problem is requiring a complete double hull for oil tankers (see e.g. DE-A-2158020) and for that purpose tankers have been built in the past with double bottoms and double sides, which, however, brought about substantial increases in the prices of tankers.

Further, double bottom constructions have the drawback that buoyancy loss in groundings may occur and in case the bottom of a cargo tank is penetrated due to corrosion and/or erosion, cargo may leak into the double bottom and generate a hazardous mixture of air and hydrocarbonaceous vapours, in case for instance oil is the cargo. Apart from the potential danger of explosion, there is the requirement for gas detection and thorough ventilation of the double bottom before entry for routine structural inspections.

Moreover, access to a double bottom also causes a problem. It must be through a vertical shaft or double side which is led right up to the deck. Other concerns include the maintenance of the steel structure in double bottoms, in particular preservation of the large coating area which is required for the prevention of corrosion. Further, double hull structures only provide adequate protection in case of low energy collisions.

Therefore, many organizations question the double hull as the best solution for pollution prevention and there is a need for alternatives provided that they offer the same level of protection against cargo outflow as the double hull tanker.

Another swash type bulkhead is disclosed by U.S. Pat. No. 3,164,120, which forms the basis for the preamble of claim 1. The location, the shape and the size of the openings in the bulkhead is determined only by considerations of (roll) stabilisation and strutural rigidity of the ship.

From FR-A-2,135,936 bulkheads are known, which are fully fluidtight: during normal operations the openings near the bottom are closed with valves, preventing an outflow in case of damage. The valves are only opened during loading/discharging and when the tanks are filled with waterballast.

Other systems with active valves are known, e.g. from W0-A-9205069 and W0-A-9208640, wherein the vales provide connections between the cargo tanks and empty rescue or evacuation tanks to focuss on the actions required. The valves are opened directly after the damage occurrence.

The state of the art illustrates the continuous preoccupation of ship builders to design tankers such that, in case of damage, the outflow of the liquid cargo can be prevented or at least be limited to a minimum as required by legal prescriptions or by insurance companies. By the present invention, this purpose is achieved in that, in a tanker with cargo tanks provided with at least one swash type bulkhead, environmental pollution is avoided or minimized in case of wreck or other marine catastrophe with a minimum increase of cost and wherein the level of protection against cargo outflow in case of damage (especially side damage) has been improved.

The invention therefore provides a tanker for carrying a liquid bulk cargo or for carrying different liquid products, said tanker comprising at least a liquid cargo tank which is provided with at least one swash type bulk head having a plate structure, said bulk head comprising at least one liquid connection means which allows an operational through-flow in the tank during normal cargo operations, characterized in that said swash type bulk head is closed liquid-tight from deck to bottom except for said at least one liquid connection means, said liquid connection means being situated near the bottom of said tank, the height of the highest point of said liquid conection means being chosen so small that, in case of damage, the accidental outflow from the undamaged part of the cargo tank due to replacement flow will be prevented or will be limited to a required minimum.

The depending claims 2 to 8 incl. define preferred embodiments of the invention.

According to a preferred embodiment of the invention the means for prevention of accidental outflow and prevention of replacement flow comprise a full swash type bulk head having a plate structure, which is closed liquid-tight from deck to bottom except from liquid connection means opening near the bottom of said tank. Preferably the connection means comprise one or more small holes near the bottom.

Surprisingly it has been found that the presence of a few holes near the bottom of the vessel does not substantially impair the loading and unloading operations whilst accidental outflow from the undamaged part in case of an accident is substantially reduced.

The invention will now be described by way of example in more detail with reference to the accompanying drawings in which.

Figure 1:
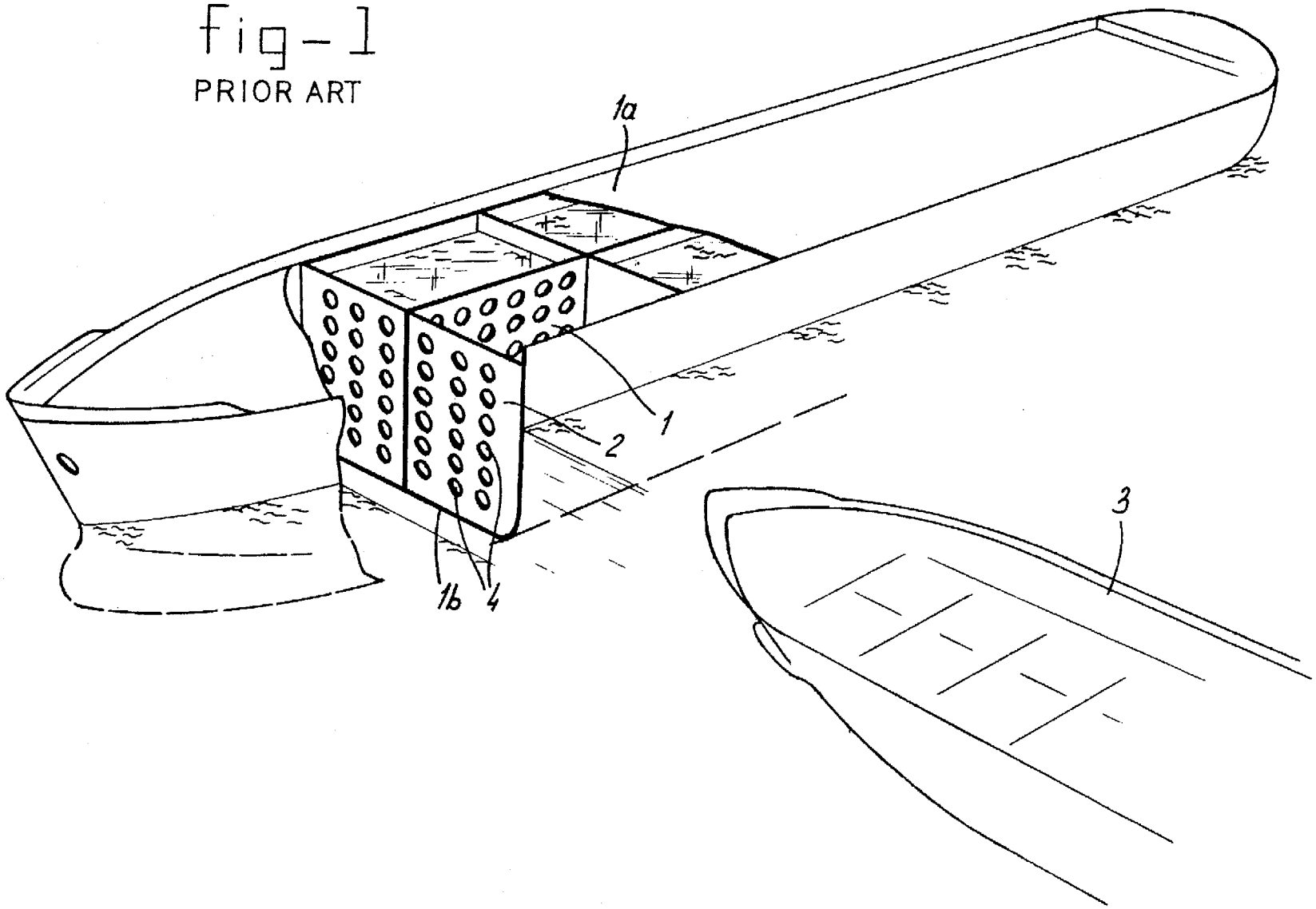
Fig-1 PRIOR ART
FIG. 1 represents schematically a perspective view of a prior art hydrostatic balanced wing tank of a tanker provided with a known swash bulkhead.

Referring to FIG. 1 a cargo tank 1 of a tanker is schematically shown, provided internally in any way suitable for the purpose with a known full swash type bulkhead 2 for reducing wave motions in (partially) filled conditions. A total bulkhead (full swash) from deck 1*a* to bottom 1*b* has been shown, wherein a number of holes 4 are spread across the total surface area.

In case of side damage by a colliding ship 3 outflow will occur so that the whole tank will be filled with sea water and all oil flows out.

Figure 2:
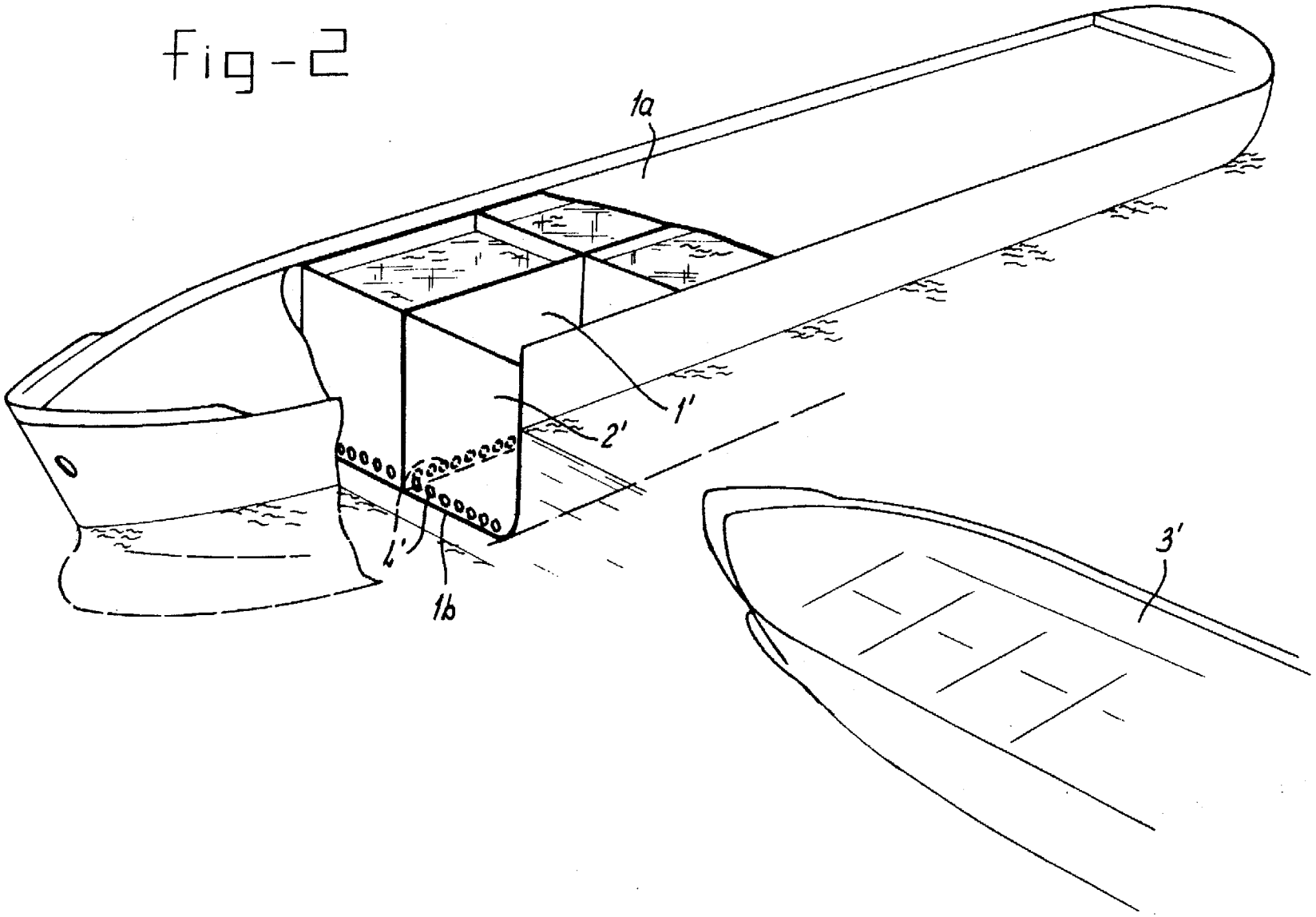
FIG. 2 represents schematically a tank of a tanker according to the invention.

In FIG. 2 a cargo tank 1' of a tanker is schematically shown, provided internally in any way suitable for the purpose with a full swash type bulkhead 2' according to the invention. The bulkhead 2' is fitted in the cargo tank with small holes 4' near the bottom 1*b* only to obtain a controlled "through-flow" of the cargo. Advantageously, the bulkhead 2' is a transverse (longitudinal) structure and is fitted at approximately half the length (breadth) of the cargo tank.

Figure 3:
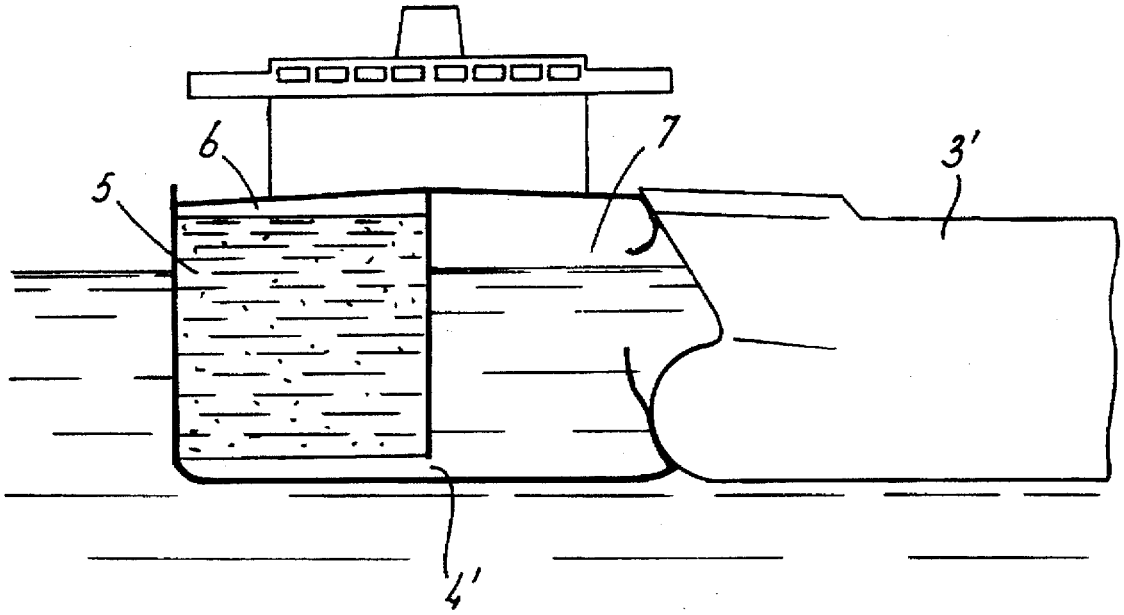
FIG. 3 represents schematically a tanker with a tank according to the invention in case of side damage conditions.

In case of side damage by a colliding ship 3', as shown in FIG. 3, part 5 of the cargo will be saved and will remain in the non-damaged left compartment 6 of the cargo tank 1' whilst compartment 7 will be completely filled with water after all is flowed out.

The total bulkhead (full swash) plating is closed watertight from deck 1*a* to bottom 1*b* except for small holes 4' near the bottom 1*b*. This has the following advantages:

Prevention of accidental outflow from an adjacent tank (in hydrostatic balance);

Light standard construction at low costs;

Reliable functioning without maintenance;

Little disadvantages for normal cargo operations.

The total concept offers good ecological and economical prospects.

The small holes 4' near the bottom 1'*b* will allow the operational flow of cargo during loading and discharge, but will prevent the accidental outflow caused by the differences in specific gravity of cargo oil and (sea) water. The size of the holes 4' is sufficient to prevent hydrostatic loading on the bulkhead and therefore the structure remains relative light (although the weight will be slightly higher than a conventional full swash type bulkhead).

The principle of the bulkhead of the invention is based upon the prevention of cargo outflow due to the differences in specific gravity of cargo and (sea) water, the so called replacement flow, provided that the cargo has the lower specific gravity. However, the bulkhead of the invention does not prevent pressure outflow and therefore this bulkhead is most effective in hydrostatic balanced tanks.

The replacement flow process in case of damage is described below in order to explain the functioning of the bulkhead of the invention.

The difference in specific gravity of cargo oil and (sea) water will induce a slow flow process, which can be described by the three phases of outflow after side penetration of a cargo tank below the water-line:

a) Initial Situation:

No pressure outflow occurs: Pressure of cargo inside and water outside are equal (so called "hydrostatic balance").

b) Intermediate Situation:

A slow flow process is induced by the difference in specific gravity of cargo oil and sea water: Lighter cargo will flow out at the upper part of the damage and heavier (sea) water will flow in at the lower part.

c) Final Situation:

This slow flow process continues until all the cargo below the highest damage point is replaced. The remaining cargo above the highest damage point is safely protected from further outflow.

The bulkhead of the invention is similar to a cargo tank wall with small side damage holes near the bottom: The liquid cargo below the highest damage point will be replaced, but the remaining cargo above the highest point will be safely protected from further outflow. Since the maximum height of these holes is small, the total outflow remains also small.

In case of bottom damage, in particular a dynamic outflow may occur, which means that, due to turbulence affects, at least part of the cargo from the non-damaged part of the tank is flowing out of the tank. This can be reduced by fitting the swash-type bulkhead of the invention in the tank in question.

The outflow can be limited to an absolute minimum (smaller than 1%) by limiting the size of the holes, by positioning them between the bottom longitudinal/transverse plate panel stiffeners and by fitting a primary transverse/longitudinal construction element on both sides of the opening.

The holes near the bottom shall have sufficient size to minimize dynamic loads during sailing and hydrostatic loads during cargo operations.

For a Very Large Crude Carrier it has appeared that in practice 6–9 holes are sufficient. The hole dimensions should be such that they provide access for inspection purposes and the like.

Usually the dimensions are at least 600×400 $mm^2$.

In damaged condition a small hydrostatic load occurs in the upper part of the bulkhead, but this load is small compared with the normal sloshing loads.

It will be appreciated by those skilled in the art that the bulkhead applied in the invention could be of corrugated structure in order to improve tank cleaning performance.

Advantageously, to prevent unintended hydrostatic loading of the bulkhead an equalization pipe can be fitted on both sides of the bulkhead of the invention and connected at sufficient height above hydrostatic balance level in order to prevent cargo overflow (outflow) in damaged condition.

It will be appreciated that the bulkhead of the invention can be refitted in an existing tanker or could be included in a new tanker design.

It will also be appreciated by those skilled in the art that the application of the bulkhead of the invention is useful in cases of side damage only, but also is useful in cases of bottom damage.

It will further be appreciated by those skilled in the art that the invention is not restricted to the application of full swash bulkheads, but can also be applied for upper part bulkheads wherein the lower part is open, provided that they fulfil the requirement of prevention of accidental outflow from the undamaged part of the cargo tank and prevention of replacement flow in case of damage whilst allowing operational "through-flow" in the tank. Advantageously, an opening having a height of 0.5 H or less can be applied (H=height of tank).

Various modifications of the present invention will become apparent to those skilled in the art from the foregoing description. Such modifications are intended to fall within the scope of the appended claims.

I claim:

1. A tanker comprising a cargo tank, at least one bulk head subdividing said cargo tank into at least two compartments, said compartments being at least half full of a liquid cargo having a specific gravity less than water, said compartments being closed liquid tight from top to bottom except for at least one permanently open hole at the bottom of the compartments through which said compartments permanently communicate with each other, the level of said liquid in the compartments being spaced above the highest point of said at least one hole by a distance equal to at least half the height of the compartments.

2. A tanker as claimed in claim 1, wherein the tanker is elongated and at least one said bulk head is disposed transversely to the length of the tanker.

* * * * *

UNITED STATES PATENT AND TRADEMARK OFFICE

CERTIFICATE OF CORRECTION

PATENT NO. : 5,664,514

DATED : September 9, 1997

INVENTOR(S) : Markus VAN DER LAAN

It is certified that error appears in the above-indentified patent and that said Letters Patent is hereby corrected as shown below:

On the Title page, item [19] change the inventor's surname from "LAAN" to --VAN DER LAAN--.

Signed and Sealed this

Twenty-eighth Day of October, 1997

Bruce Lehman

*Attest:*

BRUCE LEHMAN

*Attesting Officer*

*Commissioner of Patents and Trademarks*